US005165135A

United States Patent [19]

Su

[11] Patent Number: 5,165,135

[45] Date of Patent: Nov. 24, 1992

[54] TOOTHBRUSH

[76] Inventor: Chan B. Su, Batu 10 1/4, Kubang Jelai, Jalan Tokai, Kedah, Malaysia

[21] Appl. No.: 782,759

[22] Filed: Oct. 22, 1991

Related U.S. Application Data

[63] Continuation of Ser. No. 416,470, Oct. 3, 1989, abandoned.

[30] Foreign Application Priority Data

Oct. 19, 1988 [MY] Malaysia ..... 8801188

[51] Int. Cl.[5] ..... A46B 9/04

[52] U.S. Cl. ..... 15/167.1; 15/172; 15/144.1

[58] Field of Search ..... 15/144 R, 145, 167.1, 15/167.2, 159 R, 160, 172, 176.4–176.6, 210 R, 220 R, 230.11, 244.2

[56] References Cited

U.S. PATENT DOCUMENTS

| | | | |
|---|---|---|---|
| 74,560 | 2/1868 | Maury | 15/167.1 |
| 430,909 | 6/1890 | Wonderly | 15/167.1 |
| 611,788 | 10/1898 | Lincoln | 15/144 R |
| 1,326,638 | 12/1919 | Block | 15/167.1 |
| 1,369,664 | 2/1921 | Izawa | 15/167.1 |
| 1,492,660 | 5/1924 | Arkus | 15/167.2 |
| 1,680,558 | 8/1928 | Loiselle | 15/167.1 |
| 2,146,290 | 2/1939 | Doyle | 15/167.1 |
| 2,750,616 | 6/1956 | Klugmann | 15/144 R |
| 3,868,742 | 3/1975 | Brenner | 15/144 R |
| 3,994,039 | 11/1976 | Hadary | 15/172 |
| 4,471,506 | 9/1984 | Massari | 15/176.4 |
| 4,731,896 | 3/1988 | de La Tour | 15/167.1 |

FOREIGN PATENT DOCUMENTS

| | | | |
|---|---|---|---|
| 48692/79 | 7/1980 | Australia . | |
| 62968/80 | 8/1982 | Australia . | |
| 90495/82 | 5/1983 | Australia . | |
| 41319/85 | 10/1985 | Australia . | |
| 81970/87 | 12/1987 | Australia . | |
| 71509 | 10/1893 | Fed. Rep. of Germany | 15/167.1 |
| 81382 | 5/1895 | Fed. Rep. of Germany | 15/167.1 |
| 279994 | 11/1914 | Fed. Rep. of Germany | 15/172 |
| 3423039 | 1/1986 | Fed. Rep. of Germany | 15/167.2 |
| 912722 | 8/1946 | France | 15/167.1 |
| 109001 | 1/1917 | United Kingdom | 15/144 R |

*Primary Examiner*—Harvey C. Hornsby
*Assistant Examiner*—Mark Spisich
*Attorney, Agent, or Firm*—Thomas A. Rendos

[57] ABSTRACT

A novel construction of a toothbrush is provided which allows a bristle-carrying brushing head to turn around its own axis and the said head is connectable to the distal end of an elongated handle at an angle to the plane of the said handle.

8 Claims, 5 Drawing Sheets

TOOTHBRUSH

This is a file wrapper continuation of application Ser. No. 07/416,470, filed Oct. 3, 1989, now abandoned.

BACKGROUND OF THE INVENTION

The present invention relates generally to toothbrushes and more particularly to a novel construction of a toothbrush which allows the brushing head to pivoted and to be adjustable with respect to the handle.

A prior art device in the form of a single head toothbrush bearing a plurality of tufts of bristles on its brushing head is generally known. The toothbrush is either rolled back and forth along the teeth in an oscillating motion or the toothbrush is "chewed on" in an up and down type motion. The main restriction is that the single bristle carrying head is usually formed as a planar continuation of an elongated handle. The hand holding the handle will have to move the brushing head in different orientations in order to brush efficiently the buccal and lingual surfaces of the teeth. Furthermore, for a right-handed person, this means that the brushing operation is more efficiently executed for the left half of the set of teeth than for the right half. In order to brush the right half more efficiently, the person may switch the toothbrush to his left hand. However, a right handed person is not so effective in the use of his left hand. Alternatively, the right hand may be slanted slightly.

Other prior art toothbrushes exist with different handle designs and groups of the bristles on the brushing head.

SUMMARY OF THE INVENTION

It is an object of this invention to provide a new and improved toothbrush.

It is another object of this invention to provide a toothbrush which is capable of efficiently brushing the buccal and lingual surfaces of the teeth.

It is another object of this invention to provide a toothbrush which does not make use of multiple brush-carrying heads or multiple groups of bristles.

It is another object of the invention to encourage brushing by an up and down cleaning motion.

It is still another object of this invention to provide a toothbrush which is easy and economical to manufacture and which lends itself to mass production.

The above and other objects are achieved by providing a toothbrush comprising:

1) an elongated handle, preferably non-metallic, and in particular, made up of plastics. (This handle can be of one piece design or two piece design, with a detachably positionable, pivotable joint).
2) a bristle-carrying head detachably connected to a distal end of the handle at an angle between ninety degrees and one hundred forty five degrees relative to the longitudinal axis of the handle, and away from its distal end.
3) a plurality of cleaning bristles preferably made up of plastics and mounted on the head, with their free ends forming a wavy profile.
4) a suitable means of turning the brush head about its longitudinal axis, such as a pin-hole arrangement or a lever arrangement, preferably non-metallic, in particular made up up of plastics, and fitted to the end of the head.

The foregoing and other objects and advantages will appear from the description to follow. In the description, reference is made to the accompanying drawings which form a part thereof, and in which is shown by way of illustration a specific embodiment for practising the invention. It is understood that other embodiments may be utilized and that structural modifications may be made without departing from the scope of the invention. The following detailed description is therefore not to be taken in a limiting sense.

BRIEF DESCRIPTION OF THE DRAWINGS

FIG. (1) (*a*) is an exploded view of a first embodiment of the toothbrush of the present invention, FIG. (1) (*b*) is an assembled view of the first embodiment with the bristle-carrying head shown in a first position and FIG. (1) (*c*) is a view similar to FIG. (1) (*b*) with the bristle-carrying head shown in a second position.

FIGS. (2) (*a*)–(2) (*c*) show various views of the bristle-carrying head.

Figures 1A, 1B, 1C:
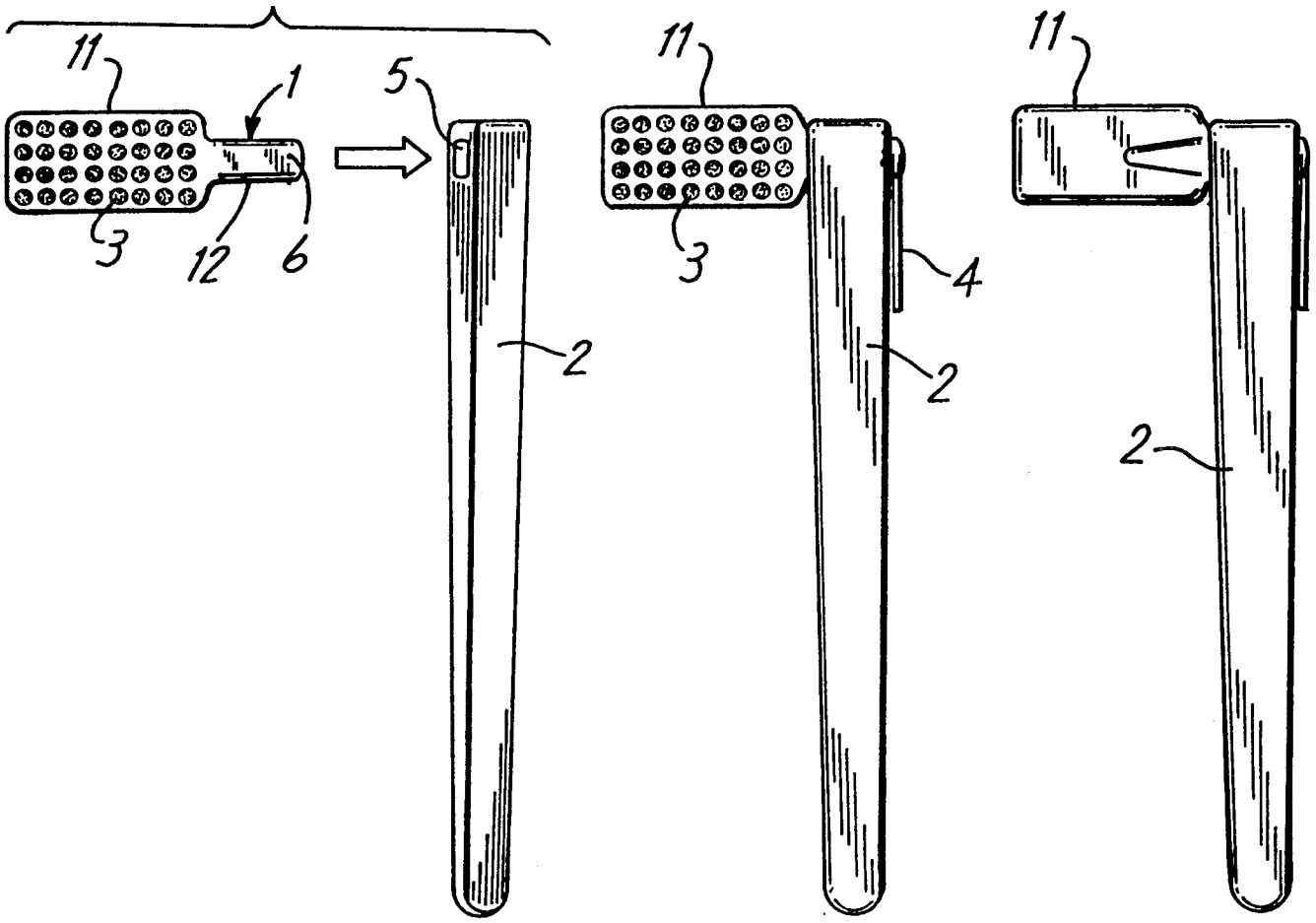
Figure 2A:
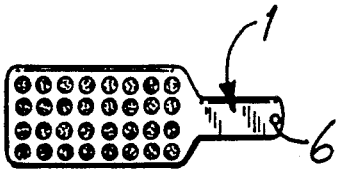
Figure 2B:
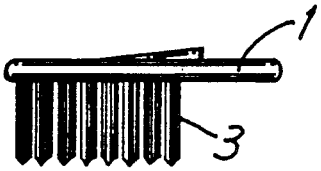
Figure 2C:
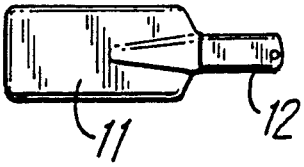
Figure 3A:
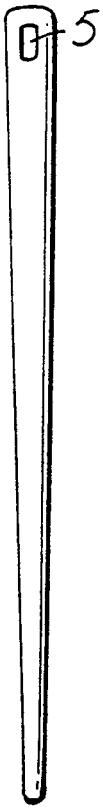
Figure 3B:
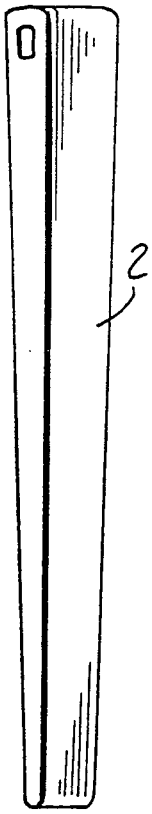
Figure 4:
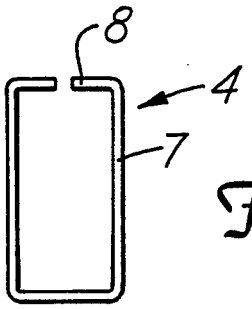
Figure 5:
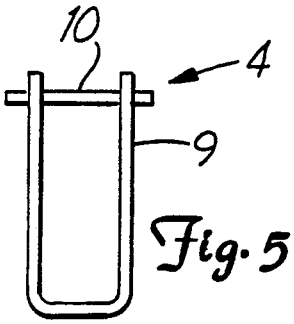
Figure 6A:
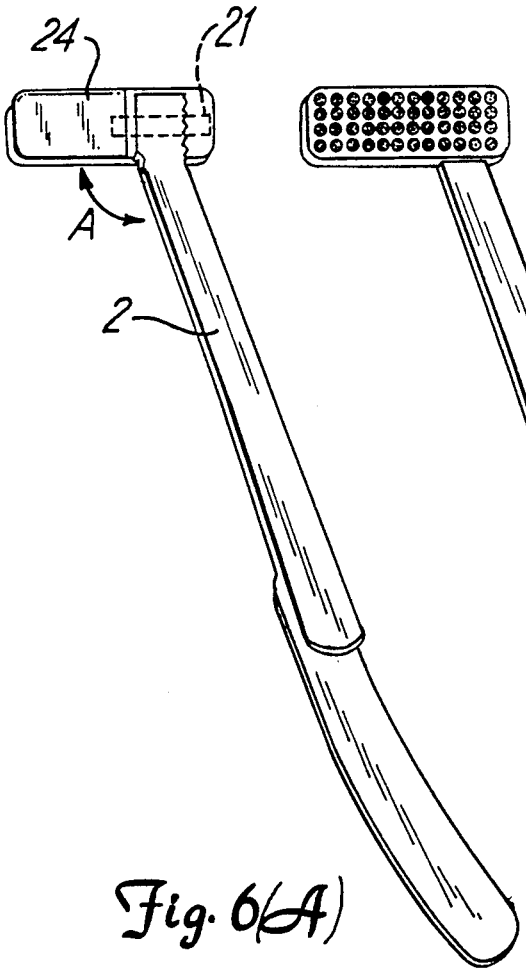
Figure 6B:
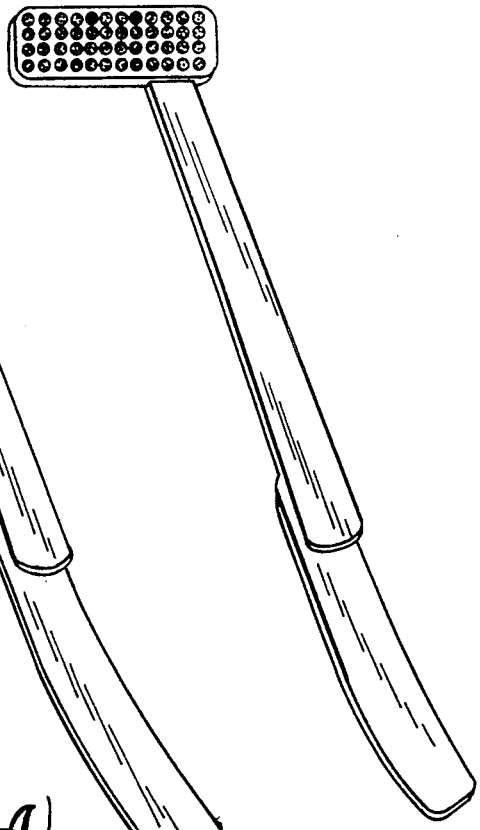
Figure 6C:
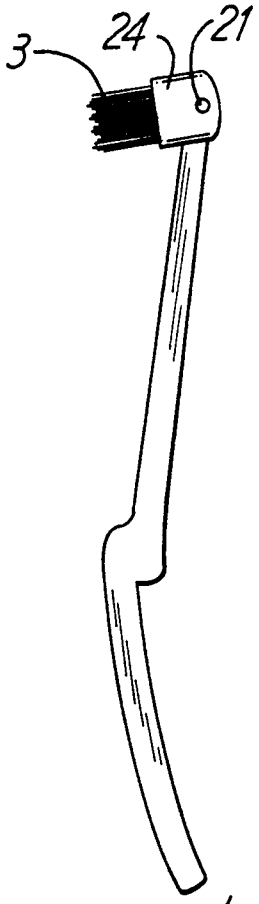

FIGS. (3) (*a*)–(3) (*b*) show a one-piece elongated handle of the first embodiment of the toothbrush shown in FIGS. (1) (*a*)–(1) (*c*).

FIG. (4) shows a view of a lever used as a means to rotate the brushing head about its longitudinal axis.

FIG. (5) shows a view of an alternative lever configuration.

FIGS. (6) (*a*)–(6) (*c*) show assembled views of an alternative embodiment of the toothbrush of the present invention.

FIG. (7) shows a pin-hole arrangement, as a means of permit rotation of the brushing head about its longitudinal axis as shown in FIGS. (6) (*a*)–(6) (*c*).

FIG. (8) shows an exploded view of yet another alternative embodiment, incorporating a two-piece handle with a selectively positionable, pivotable joint, formed by holes and a pin.

FIG. (9) shows a side view of the embodiment shown in FIG. (8).

DETAILED DESCRIPTION OF THE PREFERRED EMBODIMENTS

With reference to FIGS. (1) (*a*)–(1) (*c*), the novel construction of an improved toothbrush comprises of a one piece elongated handle (2), preferably made up of plastics, a bristles-carrying head (1), a plurality of bristle (3), and a lever (4) used as a means of rotating the bristle-carrying head (1) about its longitudinal axis. The bristle carrying head (1) serves as a brushing head.

To achieve this objective, a plurality of tufts of straight bristles (3), made up of plastics preferably, is suitably mounted on the head (1). Head (1) is moulded with a flat base (11) and a cylindrically shaped appendix (12). The bristle (3) are embedded on the flat base (11) and the appendix (12) goes through a hole (5) (defined by a circumferally shaped wall) located at the distal end of the handle (2), thereby forming a perpendicular attachment relative to the longitudinal axis of the handle (2).

Extending through the hole (5) on the distal end of the handle (2), the appendix (12) carries a small hole (6) near its extreme end perpendicular to the longitudinal extent of the appendix (12). Into this hole (6) is fitted a lever arrangement (4) which is used as a means to rotate the entire bristle-carrying head (1) about its longitudinal axis, once it is fitted.

To rotate the head (1) (FIG. (1)), an arm (7) (FIG.) (4) of the lever arrangement (4) is used to rotate the bristle-carrying head (1) relative to the hole (5). The arm (7) of the lever arrangement can be flipped down from a protruding position to a position adjacent and parallel to the longitudinal axis of the handle (2) with the arm (7) towards the direction of the holding end of the handle (2). The main object of this arrangement is such that the arm (7) does not protrude beyond the brushing head (1) and interfere with the brushing action.

There are several modifications to this lever arrangement. As shown in FIG. (4), the lever arrangement (4) consists of a generally rectangular non-metallic arm (7), particularly made up of plastics, both ends of which are bent ninety degrees inwards facing each other with a gap in between the ends. Using slight finger pressure, the gap can be extended slightly to allow the appendix (12) of the bristle-carrying head (1) to slide in between such that the short bends (8) fit into the hole (6) on the appendix (12). As shown in FIG. (5), the lever (4) consists of a U-shaped arm (9) with outwardly extending ends having holes that extend perpendicular to the longitudinal extent of the ends of the arm (9).

A non-metalic pin (10) goes through one hole on one end of the arm (9), the hole (6) on the appendix (12), and then another hole on the other end of the arm (9). This arrangement prevents the bristle-carrying head (1) from falling off the handle and acts as a means of rotating the head about its longitudinal axis.

With reference to FIGS. (6) (*a*), (*b*) and (*c*), another preferred embodiment of the invention is illustrated. The one-piece handle (2) is particularly profiled to facilitate hand-gripping. It is not straight. The bristle-carrying head (24) is connected to the distal end of the handle (2) at an approximate angle of ninety to one hundred forty five degrees to a longitudinal axis of the handle.

The bristle-carrying head is pivotable about it longitudinal axis by means of a pin-hole arrangement (21, 25). The details of this pin-hole arrangement are illustrated as in FIG. (7). The distal end (20) of the one-piece handle (2) is rounded with a hole (23) punctured in the direction perpendicular to the longitudinal extent of the handle. One surface (25) of the circular rounded end (20) is notched, while the other surface is smooth. A plurality of tufts of straight bristle (3), made up of plastics preferably, is correspondingly implanted on the head (24). The profile of the free ends of the bristle can be of various designs, particularly in a wavy form. This head is moulded to carry a slot (26) where the circular rounded end (20) of the handle is fitted. One inner surface (28) of the slot is likewise notched, corresponding to the notched surface of the circular rounded end (20) of the handle. The notched surfaces of the handle and the head provide enough friction to keep the joint firm, while still rendering the joint flexible. Thereby providing a selectively positionable, pivotable joint that resists pivotal movement during normal use of the toothbrush but is readily responsive to torque applied by a user. The head also carries a hole (27) which is in alignment with the hole (23) of the circular rounded end (23). A washer (22) made up of soft material such as rubber is placed in between the smooth inner surface of the cavity (26) and the smooth surface of the circular rounded end (20). The washer is punctured with a hole (29) which is also in alignment with the holes (27) and (23). A non-metallic pin (21) then passes through all the holes and connects the brushing head (24) to the handle (2), whilst allowing the head to be rotated about its longitudinal axis.

The handle (2) as depicted in FIG. (6) is not straight, but it is rigid with regards to the angle (A) between the head (24) and the longitudinal axis of the handle. This angle varies approximately from ninety to one hundred forty five degrees. The design of this newly improved toothbrush has one degree of freedom i.e. the brushing head is able to turn about its longitudinal axis of attachment.

Another preferred embodiment is shown as in FIG. (8), where an additional degree of freedom is incorporated, by having a 2-piece handle design. The not-so-straight handle (2) of FIG. (6) is now replaced by two pieces: one two-pronged holder element (50) and one flat adjustment arm (40).

Figure 7:
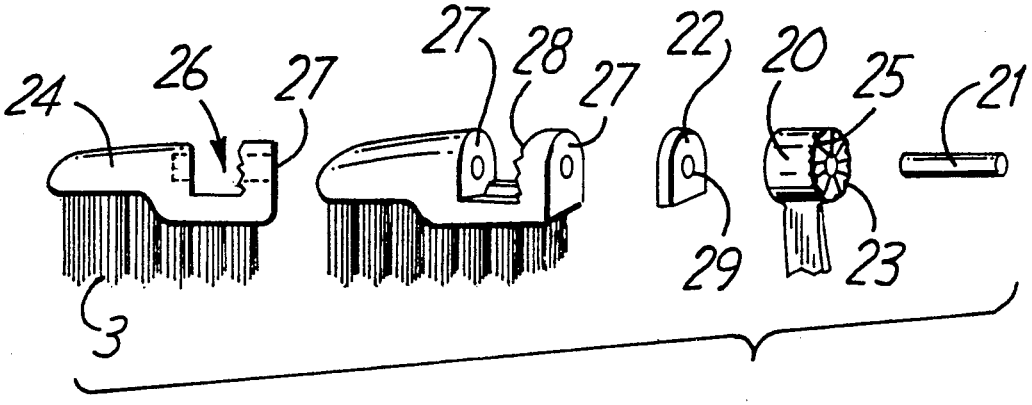
Figure 8:
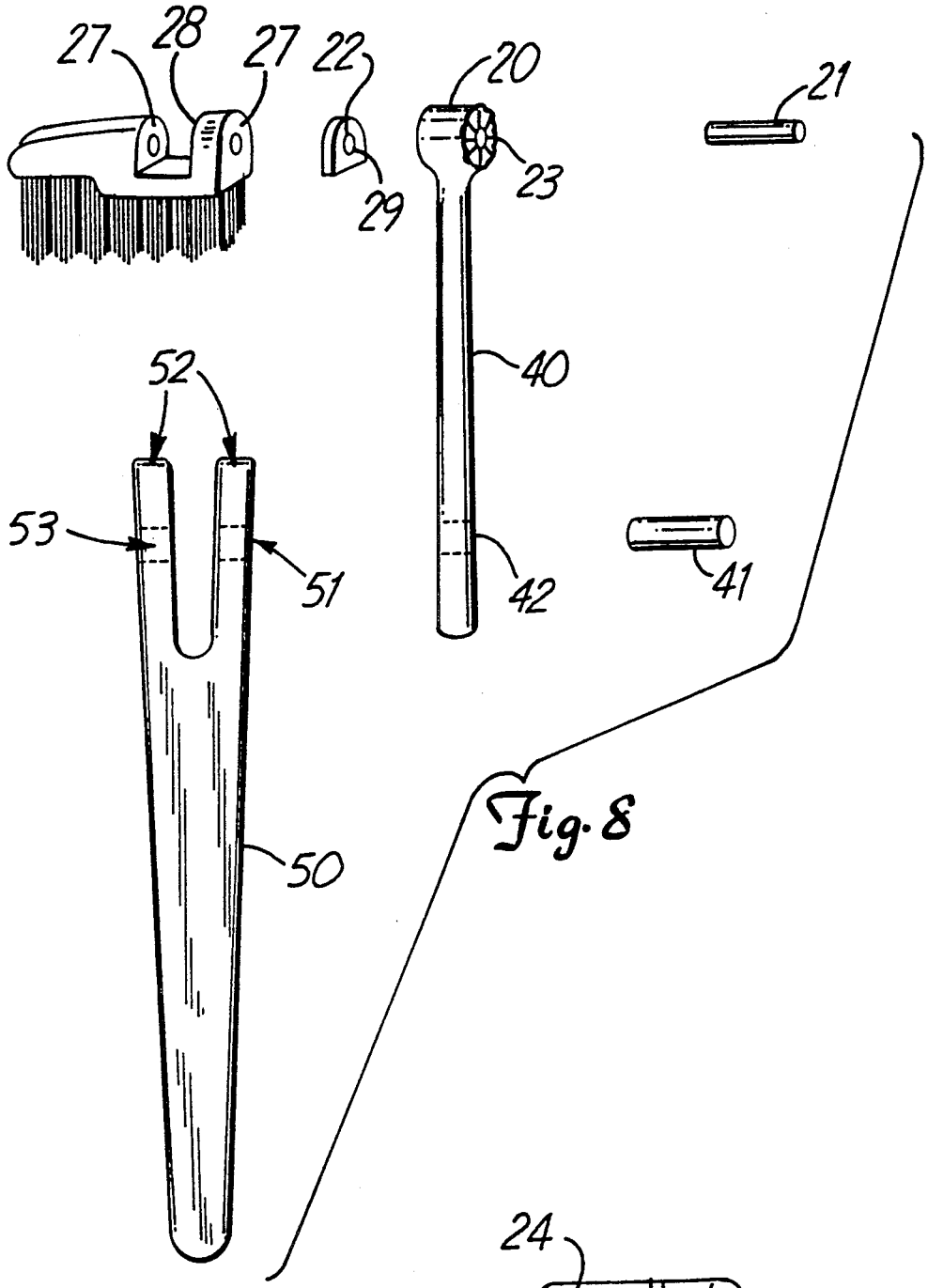
Figure 9:
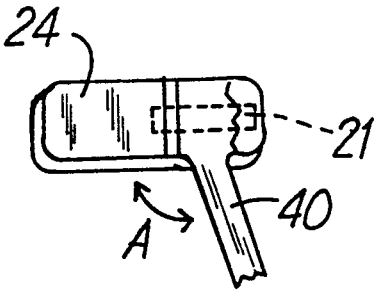

The two prongs are located at the distal end of the holder element (50), each carrying a hole (51) in each prong. One end of the flat adjustment arm (40) is sandwiched in between the prongs (52) of the holder element (50). This end also carries a hole (42) in alignment with the holes (51) in the holder element (50). A non-metallic pin (41) is fitted passing through the holes (51), (42) and (53) respectively, constituting a flexible but firm joint (i.e., selectively positionable, pivotable joint similar to that shown in FIG. 7).

The other end of the flat adjustment arm (20) is rounded with a hole (23) as previously described in FIG. (6). The end carries the brushing head (24) which also can be rotated about its longitudinal axis, in this case, hole (23), through a pin-hole arrangement.

It should be noted that the flat adjustment arm (40) needs not be straight all the way. In fact, by having a curved flat element, the degrees of freedom (of movement) are improved.

I claim:

1. A toothbrush comprising:

an elongated handle defined by a first section and a second section, each of the first and second sections having a proximal end, a distal end and a longitudinal axis extending from the proximal end to the distal end;

a first pivot support for pivotally coupling the proximal end of the second section to the distal end of the first section, such that the second section can be pivoted relative to the first section about a first pivot axis defined by the first pivot support;

a brushing head having a first end, an opposite second end and a longitudinal axis extending through the first and second ends, the brushing head including a plurality of cleaning bristles that extend perpendicular to the longitudinal axis of the brushing head and span the entire area of the brushing head from the first end to the second end along the longitudinal axis; and a second pivot support for pivotally coupling the first end of the brushing head to the distal end of the second section, such that the brushing head can be pivoted relative to the second section about its longitudinal axis, wherein the longitudinal axis of the brushing head extends parallel to the second pivot axis, wherein the brushing head is mounted at an angle with respect to the second section and wherein the mounting angle is greater than 90 degrees as measured between the longitudinal axis of the brushing head and the longitudinal axis of the second section.

2. The toothbrush of claim 1 wherein free ends of the cleaning bristles define a wave form configuration.

3. The toothbrush of claim 2 wherein the elongated handle, brushing head and cleaning bristles are formed from plastic.

4. The toothbrush of claim 1 wherein the mounting angle is less than 145 degrees as measured between the longitudinal axis of the brushing head and a longitudinal axis of the second section.

5. The toothbrush of claim 1 wherein the brushing head can pivot about its longitudinal axis through a range of movement between 145 degrees and 250 degrees.

6. The toothbrush of claim 5 wherein the range of movement of the brushing head about its longitudinal axis is 200 degrees.

7. The toothbrush of claim 1 wherein the first pivot support includes a pin closely received within aligned apertures in the proximal end of the second section and the distal end of the first section to form a pivot joint that resists pivotal movement of the second section during normal use of the toothbrush but is readily responsive to torque applied by a user to pivot the second section about the first pivot axis.

8. The toothbrush of claim 1 wherein the second pivot support includes a pin closely received within aligned apertures in the brushing head and the distal end of the second section to form a pivot joint that resists pivotal movement of the brushing head during normal use of the toothbrush but is readily responsive to torque applied by a user to pivot the brushing head about its longitudinal axis.

* * * * *